US006966844B2

(12) United States Patent
Welles

(10) Patent No.: US 6,966,844 B2
(45) Date of Patent: Nov. 22, 2005

(54) GOLF SWING PRACTICING DEVICE AND METHOD

(76) Inventor: Raymond Welles, 104 Knight St., Oceanside, NY (US) 11572

( * ) Notice: Subject to any disclaimer, the term of this patent is extended or adjusted under 35 U.S.C. 154(b) by 63 days.

(21) Appl. No.: 10/752,907

(22) Filed: Jan. 6, 2004

(65) Prior Publication Data

US 2005/0148402 A1 Jul. 7, 2005

(51) Int. Cl.[7] ..... A63B 69/36
(52) U.S. Cl. ..... 473/224; 473/219; 473/256
(58) Field of Search ..... 473/219, 221, 473/226, 224, 257, 234, 256

(56) References Cited

U.S. PATENT DOCUMENTS

| | | | | | |
|---|---|---|---|---|---|
| 1,524,196 | A | * | 1/1925 | Matthews | 473/256 |
| 2,462,955 | A | * | 3/1949 | Glancey | 473/227 |
| 4,840,371 | A | * | 6/1989 | Harris | 472/56 |
| 4,878,673 | A | * | 11/1989 | Pollard | 473/409 |
| 4,953,868 | A | * | 9/1990 | Thompson et al. | 473/234 |
| 5,031,909 | A | * | 7/1991 | Pecker | 473/463 |
| 5,167,415 | A | * | 12/1992 | Iandola | 473/256 |
| 5,221,088 | A | * | 6/1993 | McTeigue et al. | 473/201 |
| 5,423,548 | A | | 6/1995 | Bricker | |
| 5,551,696 | A | | 9/1996 | Izett et al. | |
| 5,582,407 | A | * | 12/1996 | Sorenson | 473/256 |
| 5,599,021 | A | | 2/1997 | Lary et al. | |
| 5,807,183 | A | * | 9/1998 | Benson | 473/206 |
| 5,989,131 | A | | 11/1999 | Burkholder | |
| 6,186,904 | B1 | | 2/2001 | Bass | |
| 6,293,875 | B1 | | 9/2001 | Sanford | |
| 6,296,575 | B1 | | 10/2001 | Harris | |
| 6,331,168 | B1 | | 12/2001 | Socci et al. | |
| 6,352,481 | B1 | | 3/2002 | Pak | |
| 6,383,086 | B1 | | 5/2002 | Flood | |
| 6,413,167 | B1 | * | 7/2002 | Burke | 473/224 |
| 6,441,745 | B1 | * | 8/2002 | Gates | 340/669 |
| 6,450,893 | B1 | | 9/2002 | Primiano et al. | |
| 6,458,040 | B1 | | 10/2002 | Veazie, III | |
| 6,467,097 | B1 | | 10/2002 | Kutner | |
| 2002/0094879 | A1 | * | 7/2002 | Dawson | 473/219 |

* cited by examiner

*Primary Examiner*—Raleigh W. Chiu
(74) *Attorney, Agent, or Firm*—Frishauf, Holtz, Goodman & Chick, P.C.

(57) ABSTRACT

Device and method for enabling practice of the turning-over movement of wrists during a golf swing without using a standard-size golf club. The device includes a shaft having a grip at one end and a length one half or less than the length of the standard size golf club and a golf ball attached to an opposite end of the shaft. By gripping the grip and swinging the shaft, the turning-over movement of the wrists during swinging of a standard-size golf club can be practiced. However, the device is smaller than a full size golf club and thus can be used in more situations, e.g., when sitting down in a chair or seat. The device can be provided with a voice-output capability to provide golf tips to the golfer practicing his or her swing.

14 Claims, 2 Drawing Sheets

GOLF SWING PRACTICING DEVICE AND METHOD

FIELD OF THE INVENTION

The present invention relates generally to a device and method for practicing golf swing, and more particularly to practicing the "turning-over" movement of the wrists during a golf swing. Still further, the invention relates to a device and method for enabling practicing of a golf swing almost anywhere.

The present invention also relates to a golf swing practicing device which provide audible tips to improve the golf swing during use.

BACKGROUND OF THE INVENTION

When swinging a golf club, the wrists are "turned-over" to impart a spin to the golf ball upon impact between the golf club and the golf ball thus achieving longer distance when hitting the ball.

Although numerous devices exists to enable a golfer to practice his or her swing (such as described in U.S. Pat. Nos. 5,551,696, 5,599,021, 5,989,131, 6,293,875, 6,296,575, 6,352,981 and 6,383,086), there is no special device which enables a golfer to practice in particular the turning-over movement from any position including a seated position without using a standard-size golf club or other device having a length almost the same as the length of a standard-size golf club.

Of interest, U.S. Pat. No. 5,599,021 describes an exercise device including a shaft having a grip and an end weight connected to the shaft by a flexible spring. When swinging the device, the spring is extended. The device is allegedly beneficial to rapidly loosen and stretch muscles, ligaments and tendons. During swinging of this prior device, the spring flexes and the weight moves, thus presenting the danger of the user hitting his/her body and/or furniture or the like while practicing his/her swing while sitting, for example, at a desk. Moreover, U.S. Patent No. 5,599,021 makes no mention at all about practicing the turning-over movement of the wrists during a golf swing.

There are several aspects of a golf swing which contribute to an ideal swing. First, the grip on the golf club is a very important part of the swing and extreme care should be taken to provide for a proper grip. Second, the posture is ideally maintained level throughout the swing, i.e., the head, shoulders, torso, hips and knees should be as level as possible. Third, throughout the swing, the golfer's elbows should be the same distance apart. When the elbows are connected through the hitting area of the swing, the left arm will rotate while the right arm will extend and cross the left (for a right-handed golfer). Lastly, it is advantageous to establish a smooth, rhythmic tempo.

It is difficult for average golfers to bear all of these points in mind when swinging the golf club. Therefore, it would be advantageous to enable a golfer to be reminded of these points while grasping the golf club and practicing swinging movements.

OBJECTS AND SUMMARY OF THE INVENTION

It is an object of the present invention to provide a new device and method for practicing the turning-over movement of the wrists (hands) during a golf swing.

It is another object of the present invention to provide a new device and method for practicing the turning-over movement of the wrists during a golf swing which is smaller than a standard-size, full-length golf club.

It is still another object of the present invention to provide a new device and method for practicing the turning-over movement of the wrists during a golf swing which can be used in various postures, including in a seated position, and even while sitting, for example at a desk.

It is yet another object of the present invention to provide a new device and method for practicing the turning-over movement of the wrists during a golf swing which is weighted by an actual golf ball and thus better simulates the desired turning-over movement during a golf swing.

Still another object of the present invention is to provide a new device which enables a golfer to be reminded of tips for swinging the golf club when grasping the golf club.

In order to achieve these objects and others, a device for enabling practice of the turning-over movement of wrists during a golf swing without using a standard-size golf club, comprises a shaft having a grip at an end and a length one half or less than the length of the standard-size golf club and a golf ball or other weight or decorative weight member attached to an opposite end of the shaft. By gripping the grip and swinging the shaft, the turning-over movement of the wrists during swinging of a standard-size golf club can be simulated and practiced. However, the device is smaller than a standard-size, full-length golf club and thus can be used in more situations, e.g., when sitting down in a chair or seat, even at a desk.

The golf ball or the weight at the end of the shortened shaft simulates the actual weight and feel of a conventional golf club and improves the training effect.

In one embodiment of the device, an audio generating unit is arranged in the shaft to generate audible words, phrases or sentences relating to the golf swing, i.e., golf tips. The audio generating unit may include a processor arranged in the shaft, an audio speaker coupled to the processor, a battery for powering the processor and the speaker and one or more sensors for detecting use of the device. The processor is coupled to the sensors and directs the speaker to generate an audible phrase upon detection of use of the device by the sensor(s). Possible sensors include a pressure sensor arranged in the shaft underneath the grip to detect pressure applied thereto and an acceleration sensor arranged in the shaft to detect acceleration thereof. A switch on an exterior surface of the shaft is provided to control the generation of the audible phrases, i.e., it toggles the power provided by the battery.

By providing audible golf tips during use of the device, the golfer can not only practice the turning-over movement, but can be directed as to how his or her golf swing can be improved.

A related method for practicing of the turning-over movement of wrists during a golf swing without using a standard-size golf club comprises attaching a golf ball or other weight or decorative weight member to an end of a shaft having a length one half or less than the length of the standard-size golf club, attaching a grip to an opposite end of the shaft and gripping the grip and then swinging the shaft to practice the conventional golf club swing and the turning-over movement of the wrists during swinging of a standard-size golf club.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE PREFERRED EMBODIMENTS

Figure 1:
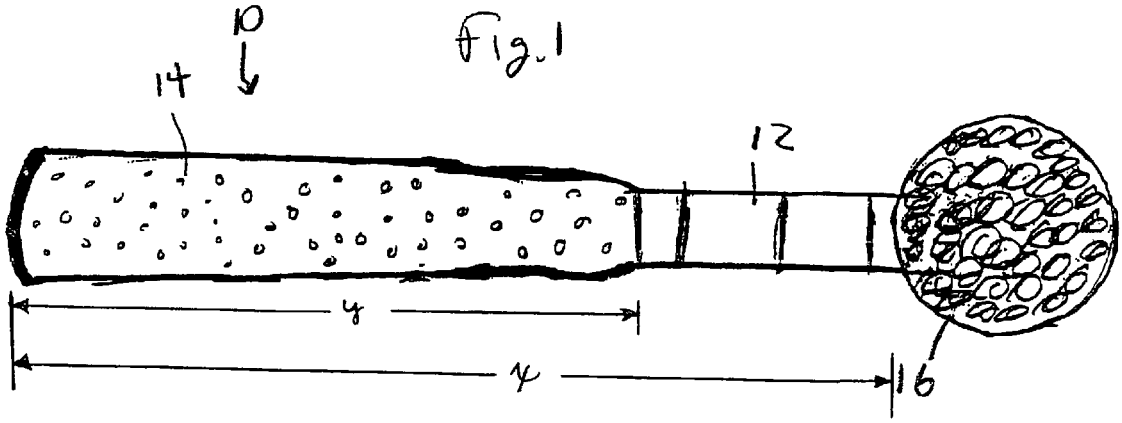
FIG. 1 is a side view of the device in accordance with the invention for use in the method in accordance with the invention.
Figure 2:
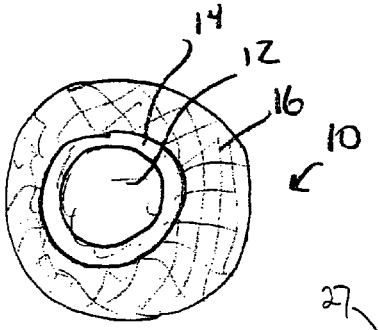
FIG. 2 is a top view of the device shown in FIG. 1.

Referring to FIGS. 1–4, a first embodiment of the device in accordance with the invention is designated generally at 10 and includes a short shaft 12 having a standard (real) golf club grip 14 at one end and a standard golf ball 16 fixed to the other end of the shaft 12. As known to those skilled in the art, the grip 14 is a tubular construction and is placed on the shaft 12.

The shaft 12 and grip 14 are constructed in the usual manner as shafts and grips of standard-size golf clubs to provide the user with the proper feel when practicing with the device, with the important difference in the length of the shaft 12. The shaft 12, grip 14 and the termination member 16 make up a rigid structure which will not flex during use.

To enable use of the device 10 to practice the turning-over movement of the wrists from any position including a seated position, the length of the device 10 is significantly less than the length of a standard-size golf club. Thus, the length of the device 10 can be about one-half or less of the length of a standard-size golf club.

In one particular embodiment, the shaft 12 has a length x of about 17.5 inches with the standard-type grip 14 having a length y of about 11.5 inches. The ball has a diameter of about 1.625 inches so that the total length of the device 10 is about 19.5 inches. Other dimensions could also be used. For example, x may be between about 16 to 18 inches and could even be between about 14 and 18 inches. The maximum length could be increased, as desired.

The golf ball 16 may be decorated or may be any conventional golf ball. It is arranged at the distal end of the shaft 12 to add weight at the end of the shaft 12 to provide better balance and simulation of the actual feel of a golf club which will be swung. The golf ball 16 may be fixed to the end of the shaft 12 in a variety of ways including screw threads 20 (see FIG. 3) bonding techniques, adhesive and any other suitable technique, depending upon the materials used.

It is also possible that the golf ball 16 at the end of the shaft 12 is omitted and the distal end of the shaft 12 is rounded or otherwise terminated to prevent damage or injury to the user or the surroundings. Still further, the golf ball 16 can be replaced by a weight or other decorative weight or termination member, as desired.

Figure 3:
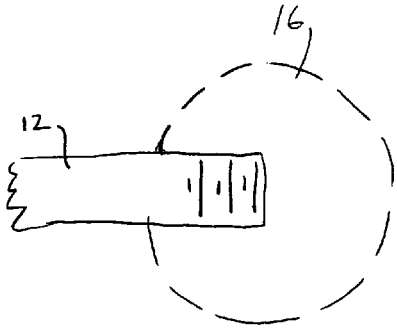
FIG. 3 shows the attachment of a termination member to the shaft.
Figure 4:
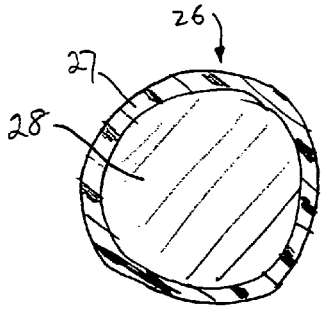
FIG. 4 shows an alternate termination member.

Referring to FIG. 4, the golf ball type termination member 26 (which replaces the golf ball 16 of FIG. 1) may be provided with an elastomeric outer coating 27 over a hard internal portion 28. The outer elastomeric or other resilient coating 27 is sufficiently soft so as to prevent damage to articles during use of the device, for example to prevent damage to furniture or the like. The elastomeric covering can be rubber, foam or other suitable resilient outer coatings, and the internal portion 28 of the termination member may be made of metal (so as to provide a "weight") or plastic or other suitable materials. The termination member 26 can be approximately the size of a golf ball and/or the approximate weight of a golf ball. The attachment of the member 26 to the end of the shaft 12 may be as shown in FIGS. 1 or 3, or can be by means of adhesive or the like.

In use, the golfer who wants to practice the turning-over movement of the wrists grips the grip 14 of the device 10 with both hands in a usual golf swinging manner, one hand above the other. The golfer practices swinging and turning-over the wrists by moving the device 10 through the air. The golfer may perform this movement when standing or sitting down—when while sitting at, for example, a desk.

Thus, disclosed above is a device for enabling practice of the turning-over movement of the wrists during a golf swing that provides a genuine feel of a real golf club yet is smaller than a standard-size golf club, and which reduces the chance of damage to the surroundings due to its small size.

Figure 5:
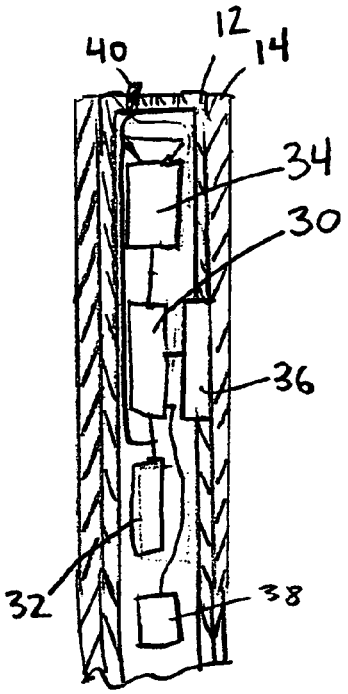
FIG. 5 is a cross-sectional view of another embodiment of a device in accordance with the invention.
Figure 6:
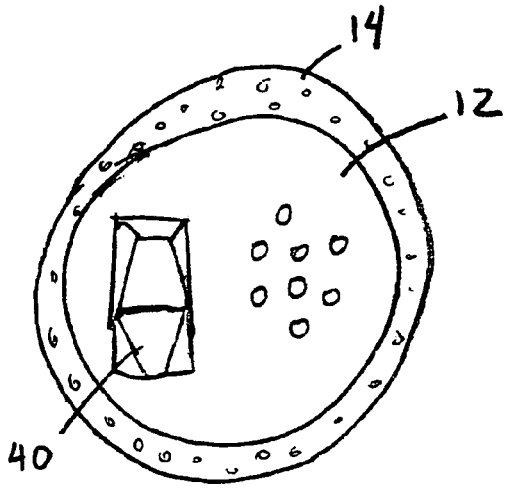
FIG. 6 is a top view of the embodiment shown in FIG. 5.
Figure 7:
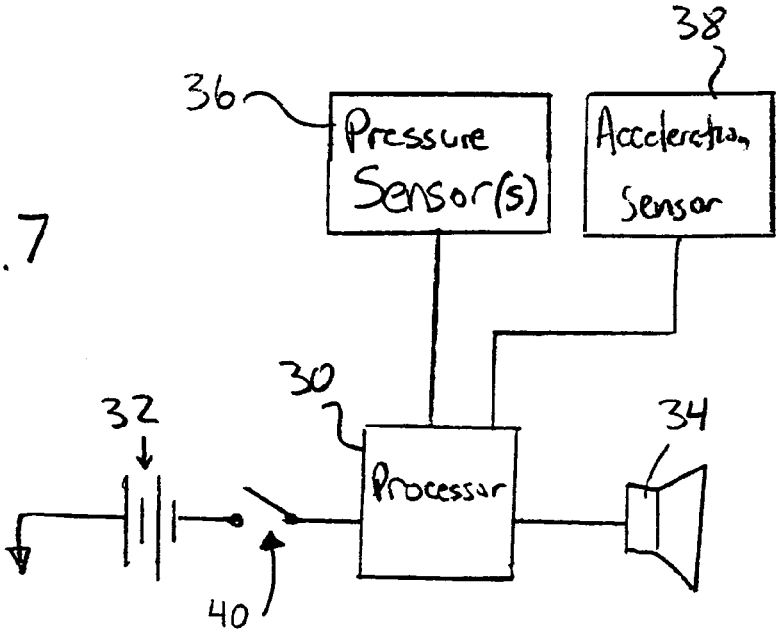
FIG. 7 is a circuit diagram of the electronic components of the embodiment shown in FIG. 5.

Referring now to FIGS. 5–7, the device 10 may be modified to include a voice-output capability. In this embodiment, the device 10 includes electronic components in the interior of the shaft 12 which generate audible words, phrases and/or sentences which relate to instructional information, such as golf tips, upon detection of a sensory input. The golf tips may relate to any aspect of the golf swing, including the grip, the position of the head, shoulders, torso, hips and knees, the relative and absolute position of the elbows and the tempo.

More specifically, a processor 30 is arranged in the shaft 12 and is powered by a battery 32. Battery 32 also powers an audio speaker 34 coupled to the processor 30. The processor 30 is activated by one or more sensors 36, 38 to cause the audio speakers 34 to generate the audible golf tips. Sensor 36 is a pressure sensor arranged in the shaft 12 underneath the grip 14 and detects pressure applied to the grip 14 by the golfer when using the device 10 (see FIG. 5). Sensor 38 is an acceleration sensor arranged in the interior of the shaft 12 and detects acceleration of the device 10, which is present when the device is raised into an elevated, ready position from which the golfer will begin the golf swing (see FIG. 5).

It is also conceivable to provide multiple pressure sensors 36 wherein each pressure sensor causes the generation of a golf tip related to a different aspect of the swing. That is, one pressure sensor would be designed so that when depressed, it causes audible messages which relate to the position of the feet, another pressure sensor when depressed would cause audible messages which relate to the position of the hands, etc. Indicia as to which pressure sensor causes which type of audible messages could be associated with each pressure sensor.

To enable the golfer to selectively activate the processor 30, a switch 40 is arranged in the upper surface of the shaft 12 to toggle the power provided by the battery 32 (see FIG. 6). Thus, by depressing switch 40, the golfer can either hear the golf tips to mute the golf tips.

Openings are formed in upper surface of the shaft 12 to enable the audible golf tips generated by the audio speaker 34 to be heard by the golfer.

Referring to the circuit diagram shown in FIG. 7, in operation, depressing switch 40 causes the battery 32 to provide power to the processor 30. Then, when the golfer applies pressure to the sensor 36 and/or raises the device to an elevated, ready position, the processor 30 directs a signal to the audio speaker 34 to cause it to generate an audible golf tip. The golf tip may be random or may be generates as a function of the sensory inputs, e.g., if too much pressure is applied to the sensor 36, a message might be "lighten up the grip".

In addition, the message might be related to previous swings. For example, if the acceleration sensor 38 detects acceleration above a threshold during a swing, this might be indicative of a hurried swing so that the subsequent message would be "reduce speed of swing".

While particular embodiments of the invention have been shown and described, it will be obvious to those skilled in the art that changes and modifications may be made without departing from the invention in its broader aspects, and, therefore, the aim in the appended claims is to cover all such changes and modifications fall within the true spirit and scope of the invention.

I claim:

1. A device for enabling practice of a golf swing without using a standard-size golf club, comprising:

a shaft having a grip at a first end, said shaft having a length about one half or less than the length of the standard-size golf club;

a termination member attached to a second end of said shaft opposite to said first end, said shaft, grip and termination member comprising a rigid structure which does not flex in use, whereby by gripping said grip and swinging said shaft, swinging of a standard-size golf club can be practiced; and audio generating means arranged in said shaft to generate a plurality of different audible words, phrases or sentences which relate to instructional information about the golf swing, said audio generating means comprising a processor, an audio speaker coupled to said processor, a battery for powering said processor and said speaker and a plurality of pressure sensors coupled to said processor for detecting use of the device, each of said sensors being arranged to activate said processor when use of the device is detected to cause said processor to direct said speaker to generate one of the plurality of different audible words, phrases or sentences each time said sensor detects use of the device, each of said sensors causing said processor to direct said speaker to generate an audible word, phrase or sentence selected from a respective subset of the plurality of different audible words, phrases or sentences, the subset including words, phrases or sentences which relate to a particular, different aspect of the golf swing, each of said sensors including an associated indicia related to the subset of words, phrases or sentences generated by said speaker when pressure is applied to said sensor, whereby by applying pressure to said sensors prior to the golf swing, words, phrases or sentences relating to the different aspects of the golf swing are generated.

2. The device of claim 1, wherein said termination member is a golf ball, further comprising attachment means for removably attaching said golf ball to said second end of said shaft.

3. The device of claim 1, wherein said shaft has a length of about 17.5 inches.

4. The device of claim 1, wherein said grip has a length of about 11.5 inches.

5. The device of claim 1, wherein said device has a total length of about 18.5 inches.

6. The device of claim 2, wherein said attachment means comprise screw threads formed at said second end of said shaft and a recess in said golf ball including screw threads arranged to engage with said screw threads at said second end of said shaft.

7. The device of claim 1, further comprising a switch arranged on an exterior surface of said shaft for controlling power provided by said battery.

8. The device of claim 1, wherein said termination member is fixed to said second end of said shaft.

9. The device of claim 1, further comprising attachment means for attaching said termination member to said shaft.

10. The device of claim 1, wherein the termination member comprises an outer coating, said outer coating is made of an elastomeric material.

11. The device of claim 1, further comprising attachment means for removably attaching said termination member to said second end of said shaft opposite to said first end.

12. The device of claim 11, wherein said attachment means comprise screw threads formed at said second end of said shaft and a recess in said termination member including screw threads arranged to engage with said screw threads at said second end of said shaft.

13. The device of claim 1, wherein said processor is arranged to select a word, phrase or sentence from each subset randomly.

14. The device of claim 1, wherein said processor is arranged to direct said speaker to generate one of the plurality of different audible words, phrases or sentences as a function of the pressure detected by said pressure sensors.

* * * * *